US008155545B2

(12) United States Patent
Naganawa

(10) Patent No.: US 8,155,545 B2
(45) Date of Patent: Apr. 10, 2012

(54) IMAGE FORMING APPARATUS AND CHARGE-VOLTAGE GENERATING METHOD

(75) Inventor: Hiroyuki Naganawa, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 208 days.

(21) Appl. No.: 12/731,237

(22) Filed: Mar. 25, 2010

(65) Prior Publication Data

US 2010/0247126 A1 Sep. 30, 2010

(30) Foreign Application Priority Data

Mar. 31, 2009 (JP) ..... 2009-088426

(51) Int. Cl.
*G03G 15/02* (2006.01)
*G03G 15/00* (2006.01)

(52) U.S. Cl. ..... 399/50; 399/11; 399/170; 399/171

(58) Field of Classification Search ..... 399/11, 399/50, 170–173
See application file for complete search history.

(56) References Cited

U.S. PATENT DOCUMENTS 6,345,159 B1 * 2/2002 Suzuki ..... 399/50
6,763,201 B1 * 7/2004 Reijnders ..... 399/50
7,254,349 B2 * 8/2007 Kamiya ..... 399/50
7,809,293 B2 10/2010 Inukai
2008/0056740 A1 3/2008 Inukai

FOREIGN PATENT DOCUMENTS

| | | |
|---|---|---|
| JP | 02155425 | 6/1990 |
| JP | 02-097981 | 10/1990 |
| JP | 04-073669 | 3/1992 |
| JP | 07-120991 | 5/1995 |
| JP | 09-015944 | 1/1997 |
| JP | 10-003199 | 1/1998 |
| JP | 2006-030554 | 2/2006 |
| JP | 2008058481 A | 3/2008 |

OTHER PUBLICATIONS

Notification of Reasons for Refusal for Japanese patent application No. 2009-088426 mailed Mar. 29, 2011.

* cited by examiner

*Primary Examiner* — Hoang Ngo
(74) *Attorney, Agent, or Firm* — Banner & Witcoff, Ltd.

(57) ABSTRACT

An image forming apparatus includes: a calculating device configured to, in a testing mode to replace a discharge path between a charging wire and a grid of a charger with a testing resistor having a predetermined resistance, calculate a charge voltage using the resistance of the testing resistor and a detection value by a grid-current detecting circuit; and a controller configured to, in an image forming mode to actually form an image, detect the charge voltage from a feedback voltage using a relation between a value of the feedback voltage which is detected by a charge-voltage detecting circuit in the testing mode and the charge voltage calculated by the calculating device.

9 Claims, 7 Drawing Sheets

IMAGE FORMING APPARATUS AND CHARGE-VOLTAGE GENERATING METHOD

CROSS REFERENCE TO RELATED APPLICATION

This application claims priority from Japanese Patent Application No. 2009-88426 filed on Mar. 31, 2009. The entire content of this priority application is incorporated herein by reference.

TECHNICAL FIELD

The present invention relates to an image forming apparatus and a charge-voltage generating method or, specifically, relates to generation of a charge voltage that is applied to a charger included in the image forming apparatus.

BACKGROUND

A method for image forming apparatuses to detect a charge voltage applied to a charger using a voltage dividing resistor is known. Furthermore, there is an art to detect the charge voltage using an auxiliary winding that is provided at the primary winding side of the transformer used for generating the charge voltage.

However, the configuration to detect the charge voltage using the auxiliary winding of the transformer is likely to cause a detection error more than the configuration to operate the detection using the voltage dividing resistor does. On the other hand, the method of operating the detection using the voltage dividing resistor undesirably causes a power loss due to the voltage dividing resistor.

Therefore, there is a need for an image forming apparatus and a charge-voltage generating method that can provide higher accuracy with less power loss in detection of the charge voltage.

SUMMARY

An aspect of the present invention is an image forming apparatus including: a charger including a charging wire and a grid; a voltage output circuit including a transformer having an auxiliary winding, the voltage output circuit being configured to generate a charge voltage using the transformer and apply the charge voltage to the charger; a grid-current detecting circuit configured to detect a grid current that flows between the charging wire and the grid in accordance with the applying of the charge voltage; a charge-voltage detecting circuit configured to obtain the charge voltage from a feedback voltage that is generated by the auxiliary winding; a calculating device configured to, in a testing mode to replace a discharge path between the charging wire and the grid with a testing resistor having a predetermined resistance, calculate the charge voltage using the resistance of the testing resistor and a detection value by the grid-current detecting circuit; and a controller configured to, in an image forming mode to actually form an image, detect the charge voltage from the feedback voltage using a relation between a value of the feedback voltage which is detected by the charge-voltage detecting circuit in the testing mode and the charge voltage calculated by the calculating device.

DETAILED DESCRIPTION

<Illustrative Aspect>

An illustrative aspect of an image forming apparatus in accordance with the present invention will be described with reference to FIGS. 1 through 7. A laser printer will herein be illustrated as the image forming apparatus. Note that the image forming apparatus is not limited to the laser printer; for example, it may be an LED printer, a facsimile apparatus, or a multi-function machine having a copy function and a scanner function.

1. General Configuration of Laser Printer

Figure 1:
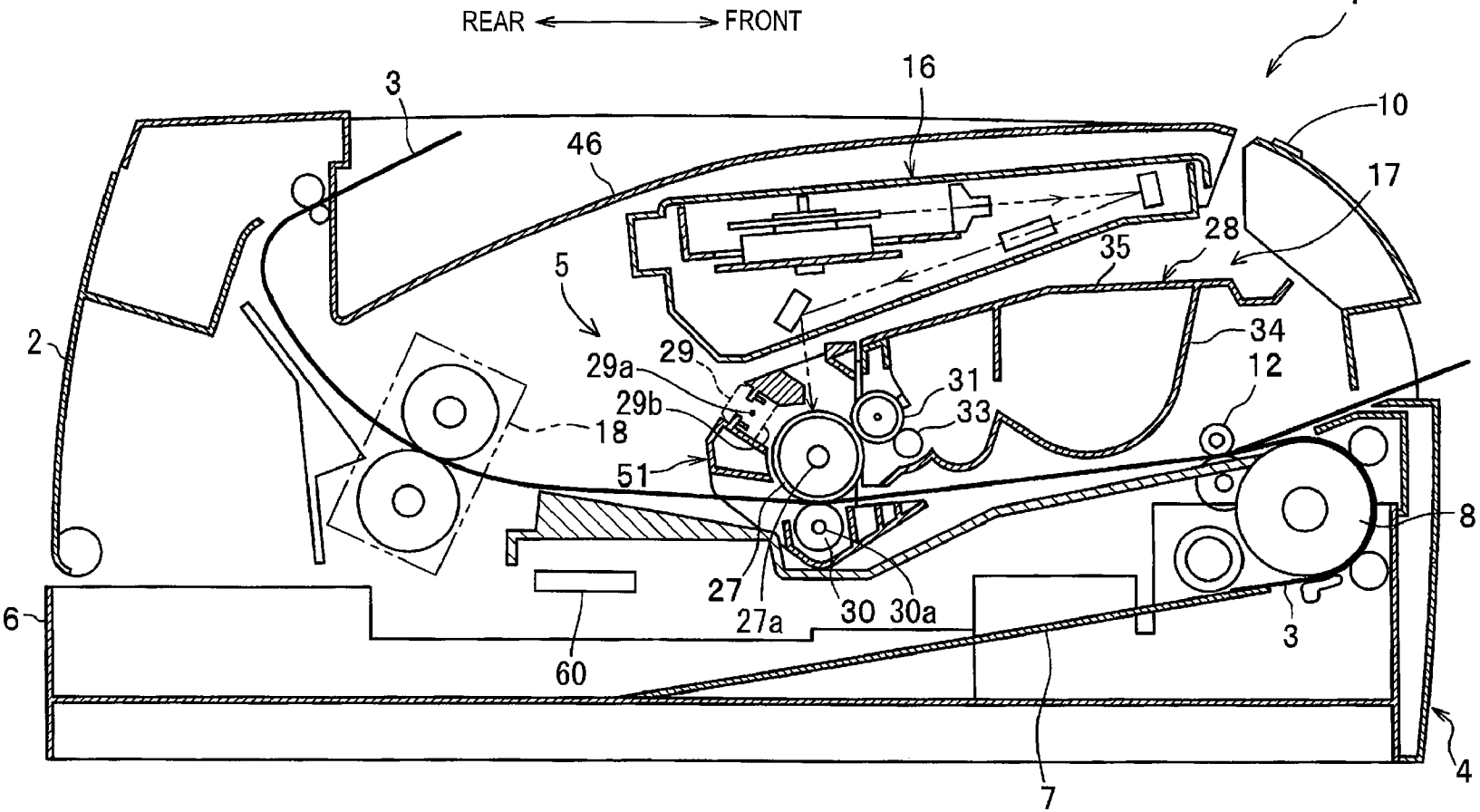
FIG. 1 is a side sectional view illustrating an internal configuration of a laser printer in accordance with the present invention.

Referring to FIG. 1, a laser printer (hereinafter referred to simply as a "printer") 1 includes a body frame 2 and, in the body frame 2, a feeder section 4, an image forming section 5, etc. The feeder section 4 can supply sheets 3. The image forming section 5 can form images on the supplied sheets 3.

(1) Feeder Section

The feeder section 4 is disposed in the bottom portion of the body frame 2. The feeder section 4 includes a sheet supply tray 6, a sheet supply roller 8, a registration roller 12, etc. The sheet supply roller 8 is disposed above an end portion of the sheet supply tray 6. Note hereinafter that the end portion (the right side in FIG. 1) will represent the front side, while the other side (the left side in FIG. 1) will represent the rear side. The registration roller 12 is disposed in the downstream of the sheet supply roller 8 in the direction to convey the sheet 3.

The sheet supply roller 8 rotates to supply an uppermost one of the sheets 3 in the sheet supply tray 6 one by one. The supplied sheet 3 is sent to the registration roller 12. The registration roller 12 registers the sheet 3 and then sends the sheet 3 to an image forming position. Note that the image forming position shall be a contact position of a photosensitive body drum (an illustration of a "photosensitive body") 27 with a transfer roller 30.

(2) Image Forming Section

The image forming section 5 includes a scanner unit 16, a process cartridge 17, and a fixing unit 18.

The scanner unit 16 is disposed in the upper portion of the body frame 2. The scanner unit 16 includes a laser emitter (not illustrated in the figure), a polygon mirror, a reflecting mirror, etc. As illustrated by a dotted line, a laser beam is emitted from the laser emitter on a basis of an image data, and a surface of the photosensitive body drum 27 is irradiated by high scanning with this laser beam via the polygon mirror, the reflecting mirror, etc.

The process cartridge 17 is disposed below the scanner unit 16. The process cartridge 17 includes a drum unit 51 and a developer cartridge 28 accommodated in the drum unit 51. The process cartridge 17 is removably accommodated in the laser printer 1. The developer cartridge 28 is removably accommodated in the drum unit 51. The developer cartridge 28 includes, for example, a developer roller 31, a toner hopper 34, etc.

The toner hopper 34 is filled with toner (developer). The developer roller 31 is disposed behind the toner hopper 34. At a time of developing, the developer roller 31 is applied with a predetermined developer bias voltage. The toner released from the toner hopper 34 is, by rotation of a supply roller 33, supplied to the developer roller 31.

The drum unit 51 includes the photosensitive body drum 27, a scorotron charger 29, the transfer roller 30, etc. The photosensitive body drum 27 is disposed in a manner opposed to the developer roller 31. The photosensitive body drum 27 includes a drum body and a drum shaft 27*a* disposed in the axis of the drum body. The drum shaft 27*a* is made of metal and is grounded. The drum body has a photosensitive layer formed on the surface thereof. The photosensitive layer has a positive charge property. In addition, an exposing aperture is provided as a passage of the laser beam above the photosensitive body drum 27.

The charger 29 is disposed above the photosensitive body drum 27 in a manner opposed thereto and with a space therebetween so as not to contact therewith. The charger 29 includes a charging wire 29*a* and a grid 29*b*. By discharging from the charging wire 29*a*, the surface of the photosensitive body drum 27 is charged uniformly, for example, positively (e.g. approximately at 700 V) via the grid 29*b*. The charging wire 29*a* is applied with a predetermined charge voltage Vchg (e.g. from 5 kV to 8 kV) from a high-voltage applying circuit 60.

The surface of the photosensitive body drum 27 is, first, as the photosensitive body drum 27 rotates, uniformly and positively charged by the charger 29. Then, the charged surface is exposed to the high scanning of the laser beam from the scanner unit 16, forming an electrostatic latent image based on the image data. Next, by rotation of the developer roller 31, the toner carried on the surface of the developer roller 31 and positively charged is supplied to the electrostatic latent image on the surface of the photosensitive body drum 27. The electrostatic latent image is thus developed.

The transfer roller 30 has a metal roller shaft 30*a* and is disposed below the photosensitive body drum 27 in a manner opposed to the photosensitive body drum 27. At a time of transfer operation to transfer the toner image carried on the photosensitive body drum 27 to the sheet 3 at the transfer position, a transfer bias voltage (a high voltage) of, for example, −6 kV is applied from the high-voltage applying circuit 60 to the roller shaft 30*a* of the transfer roller 30.

The fixing unit 18 is disposed behind, and in the downstream of the process cartridge 17 as illustrated in FIG. 1. The fixing unit 18 fuses the toner transferred onto the sheet 3. Finally, the sheet 3 is output onto a sheet exit tray 46.

2. High-Voltage Applying Circuit

Figure 2:
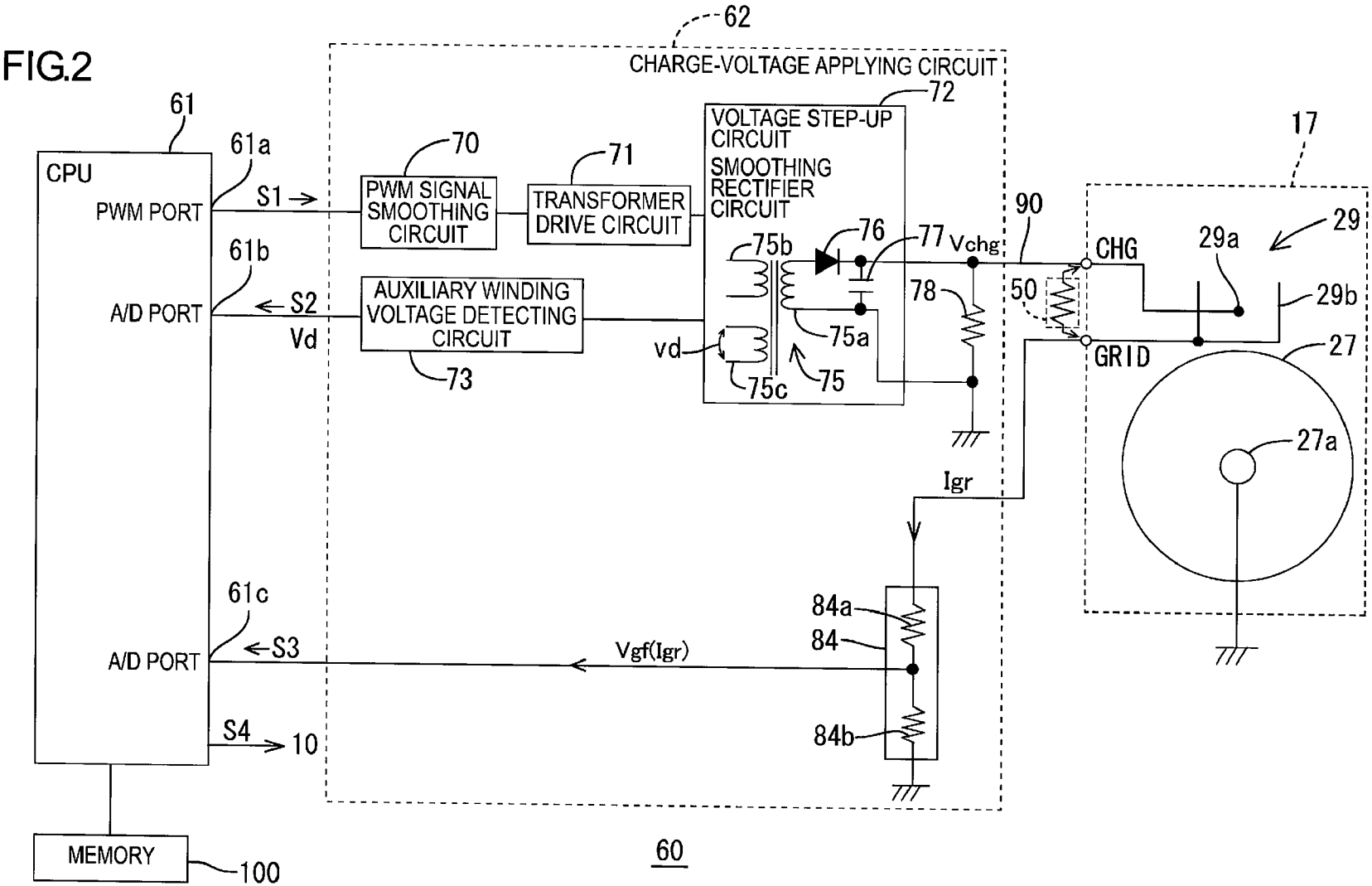
FIG. 2 is a diagram illustrating a schematic configuration of a high-voltage applying circuit.

First, the high-voltage applying circuit 60 will be described with reference to FIG. 2. FIG. 2 is a block diagram illustrating a schematic configuration of the high-voltage applying circuit 60 that applies the charge voltage Vchg to the charger 29.

The high-voltage applying circuit 60 includes a CPU (an illustration of a "calculating device", a "controller", a "control-signal generating device", and a "changing device") 61 and a charge-voltage applying circuit 62. The charge-voltage applying circuit 62 can generate and output the charge voltage Vchg. The charge-voltage applying circuit 62 is connected to a connecting line 90. The connecting line 90 is connected to the charging wire 29*a* of the charger 29. Note that the CPU 61 controls the high-voltage applying circuit 60 and, furthermore, controls components of the printer 1 related to image formation. The high-voltage applying circuit 60 also includes a circuit (not illustrated in the figure) that generates another high voltage such as a transfer bias voltage.

The high-voltage applying circuit 60 also includes a grid-current detecting circuit 84. The grid-current detecting circuit 84 can generate a grid feedback signal S3 according to a grid current Igr. The grid current Igr is a current that flows through the connecting line 90, the charging wire 29*a*, and the grid 29*b*. Note here that the grid-current detecting circuit 84 is configured by, for example, two voltage dividing resistors 84*a*, 84*b*. The grid-current detecting circuit 84 detects a grid feedback (GRID-FB) voltage Vgf, which is the grid feedback signal S3, in accordance with the dividing rate.

The CPU 61 divides the GRID-FB voltage Vgf by a resistance Rd2 of the voltage dividing resistor 84*b*, thereby calculating the grid current Igr. Then, the CPU 61 calculates the charge voltage Vchg generated by the charge-voltage applying circuit 62 using Equation 1, which is as below. This calculation is operated in a testing mode. In the testing mode, a discharge path between the charging wire 29*a* and the grid 29*b* of the charger 29 is replaced with a testing resistor 50 having a predetermined resistance.

$$Vchg=Igr*(Rdm+Rd1+Rd2) \quad \text{(Equation 1)}$$

where: Rdm is the resistance of the testing resistor 50; and Rd1 is a resistance of the voltage dividing resistor 84*a*. Thus, in this illustrative aspect, actual measurement of the charge voltage Vchg, which is a high voltage, is unnecessary.

The CPU 61 executes PWM (pulse width modulation) control for the charge-voltage applying circuit 62 to be under constant current control. In addition, the CPU 61 is connected to a memory 100. The memory (an illustration of a "storage") 100 contains a program, equations, etc. to control the high-voltage applying circuit 60.

The charge-voltage applying circuit 62 is a high-voltage generating circuit, including a PWM signal smoothing circuit 70, a transformer drive circuit 71, a voltage step-up and smoothing rectifier circuit (an illustration of a "voltage output circuit") 72, and an auxiliary winding voltage detecting circuit (an illustration of a "charge-voltage detecting circuit") 73.

The PWM signal smoothing circuit 70 smoothes a PWM signal (corresponding to a "control signal") S1 from a PWM port 61*a* of the CPU 61 and provides the smoothed PWM signal S1 to the transformer drive circuit 71. The transformer drive circuit 71, based on the smoothed PWM signal S1, applies an exciting current to a primary winding 75*b* of the voltage step-up and smoothing rectifier circuit 72.

The voltage step-up and smoothing rectifier circuit 72 includes a transformer 75, a diode 76, a smoothing capacitor 77, etc. The transformer 75 includes a secondary winding 75*a*, the primary winding 75*b*, and an auxiliary winding 75*c*. An end of the secondary winding 75*a* is connected to the connecting line 90 via the diode 76. The other end of the secondary winding 75*a* is grounded. The smoothing capacitor 77 and a resistor 78 are connected in parallel to the secondary winding 75*a*.

With the above-described configuration, the voltage in the primary winding 75*b* is stepped up and rectified in the voltage step-up and smoothing rectifier circuit 72 and is applied as the charge voltage Vchg to the charging wire 29*a* of the charger 29 connected to the high-voltage applying circuit 60.

The auxiliary winding voltage detecting circuit 73 is connected to the auxiliary winding 75*c* of the transformer 75 of the voltage step-up and smoothing rectifier circuit 72 and to the CPU 61. At a time of charging operation, the auxiliary winding voltage detecting circuit 73 rectifies an auxiliary winding voltage vd (alternating voltage) generated in the auxiliary winding 75*c* and detects the auxiliary winding voltage (corresponding to a "feedback voltage") Vd. Then, the auxiliary winding voltage detecting circuit 73 provides a detection signal S2, which is the auxiliary voltage Vd, to an A/D port 61*b* of the CPU 61. Note here that the charge-voltage detecting circuit includes the auxiliary winding 75*c*, the auxiliary winding voltage detecting circuit 73, and the CPU 61.

Figure 3:
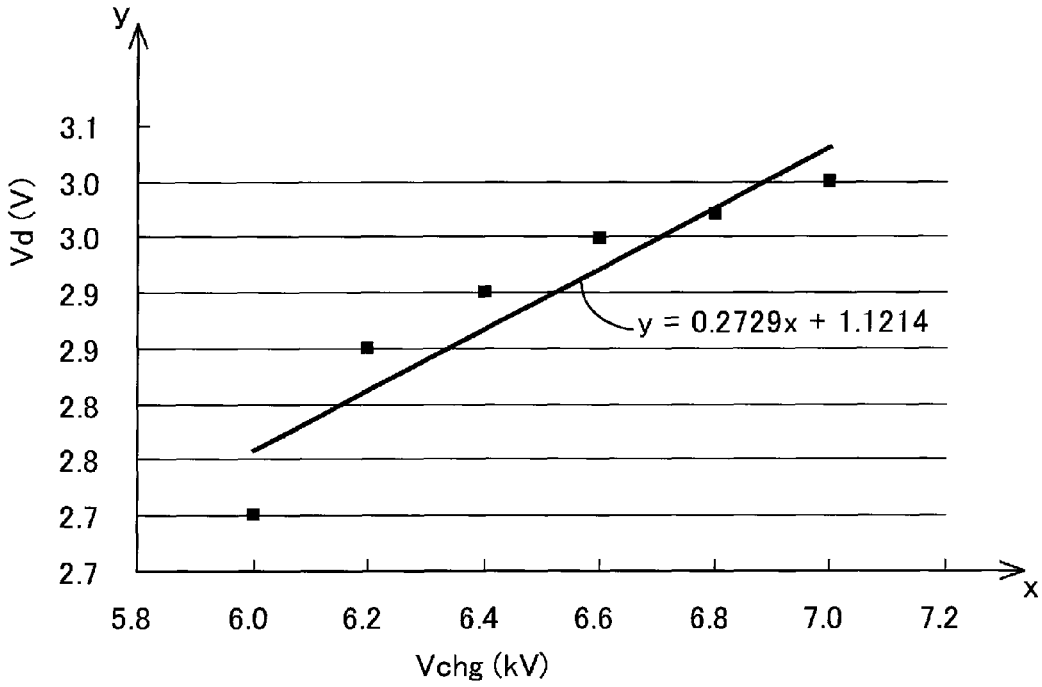
FIG. 3 is a graph illustrating an approximate equation.

In the testing mode, the CPU 61 uses the charge voltage Vchg, which has been calculated using the Equation 1, and the auxiliary winding voltage Vd to calculate an approximate equation that represents a relation between the charge voltage Vchg and the auxiliary winding voltage Vd. The CPU 61 stores the calculated approximate equation in, for example, the memory 100. The relation between the charge voltage Vchg and the auxiliary winding voltage Vd is, for example, approximated by a linear equation (a first-order equation) as illustrated in FIG. 3. In order to calculate the approximate equation illustrated in FIG. 3, the CPU 61 calculates a plurality of the charge voltages Vchg while modulating the duty ratio of the PWM signal S1 and obtains a data of a plurality of auxiliary winding voltages Vd.

Then, in an image forming mode to actually form the image, the CPU 61 uses the approximate equation stored in the memory 100 to correct the charge voltage Vchg obtained with the auxiliary winding voltage detecting circuit 73 etc. That is, conventional detection of the charge voltage Vchg is executed by multiplying the auxiliary winding voltage Vd obtained with the auxiliary winding voltage detecting circuit 73 by a turn ratio of the secondary winding 75*a* to the auxiliary winding. Different from this, in this illustrative aspect, detection of the charge voltage Vchg in the image forming mode is executed by substituting the auxiliary winding voltage Vd detected in the image forming mode into the above-described approximate equation.

3. Process of Calculating Approximate Equation

Next, referring to FIGS. 4 through 7, a process of calculating the approximate equation representing the relation between the auxiliary winding voltage Vd and the charge voltage Vchg will be described.

Figure 4:
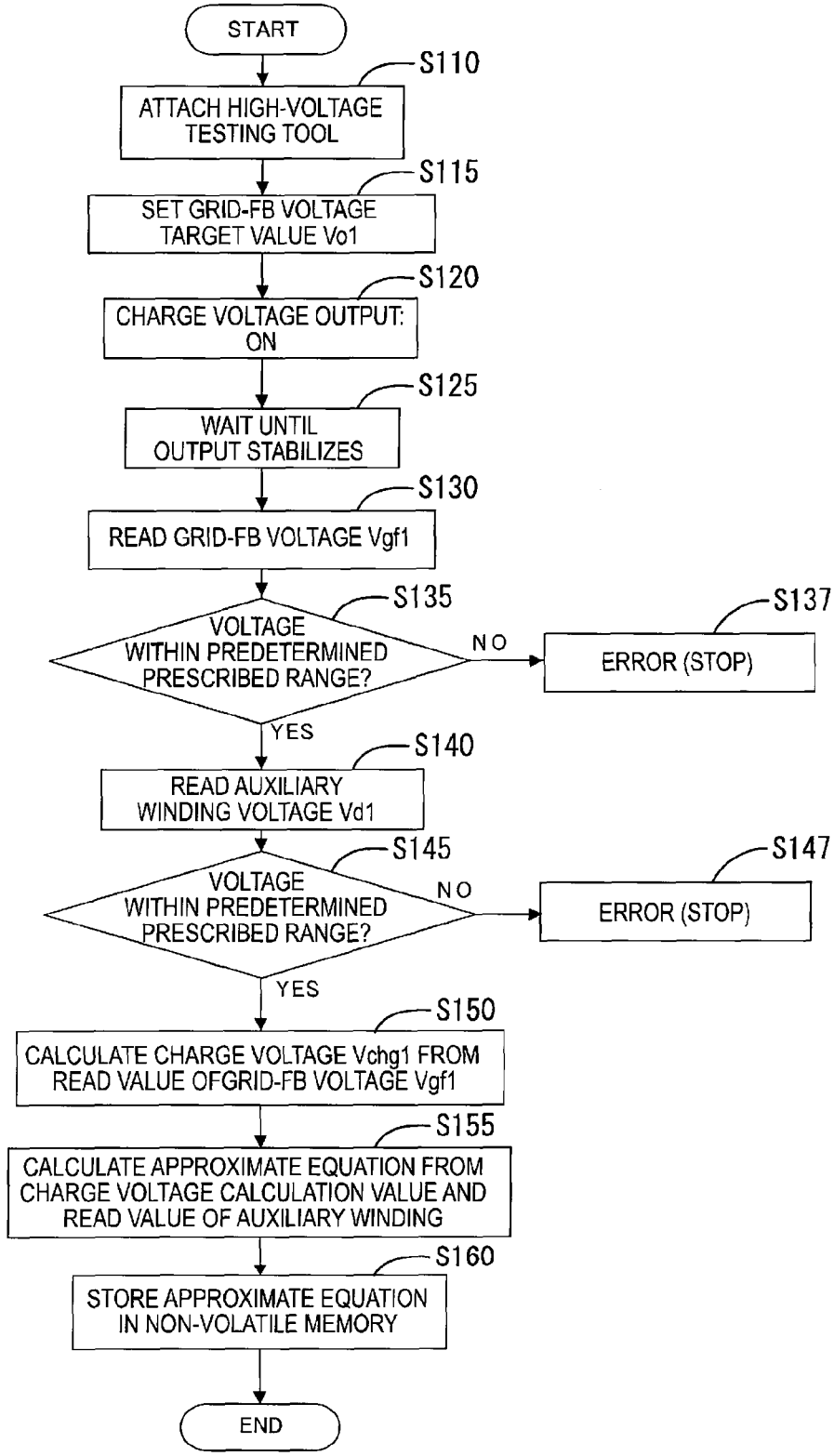
FIG. 4 is a flowchart illustrating a process of calculating a first approximate equation.
Figure 5:
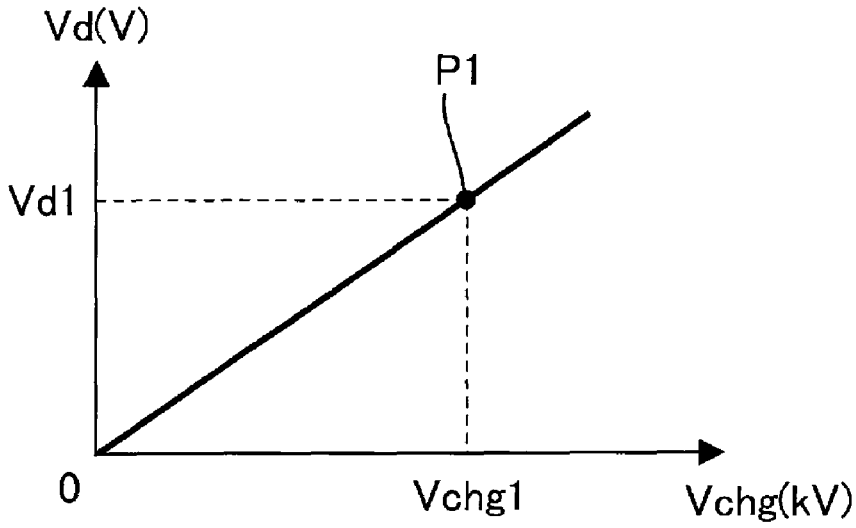
FIG. 5 is a graph illustrating the first approximate equation.

FIG. 4 is a flowchart illustrating a process of calculating a first approximate equation using a single auxiliary winding voltage Vd and a single charge voltage Vchg corresponding to the auxiliary winding voltage Vd. FIG. 5 is a graph illustrating a line representing the approximate equation. In this case, the duty ratio of the PWM signal S1 shall be a predetermined fixed value.

Figure 6:
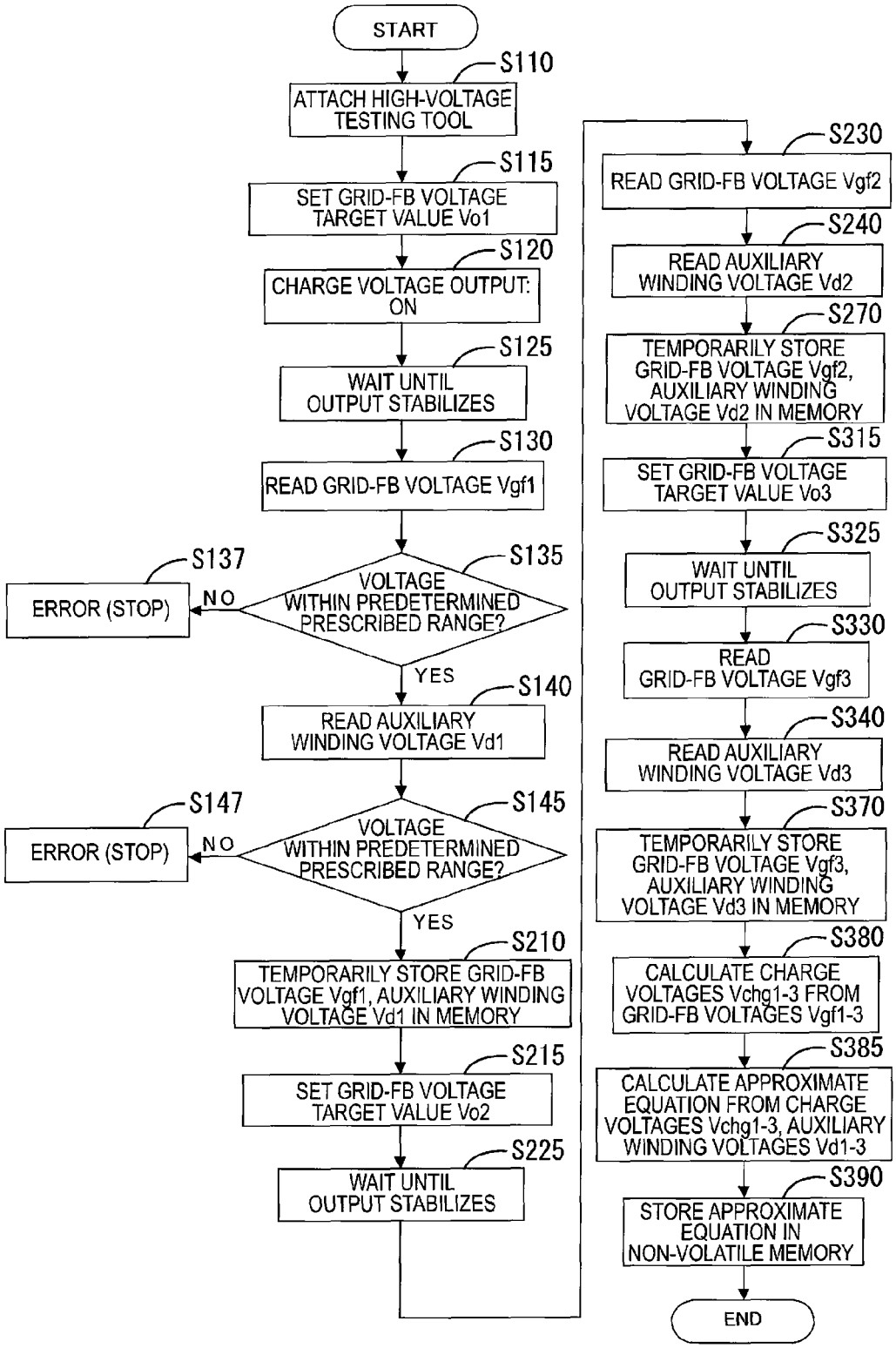
FIG. 6 is a flowchart illustrating a process of calculating a second approximate equation.
Figure 7:
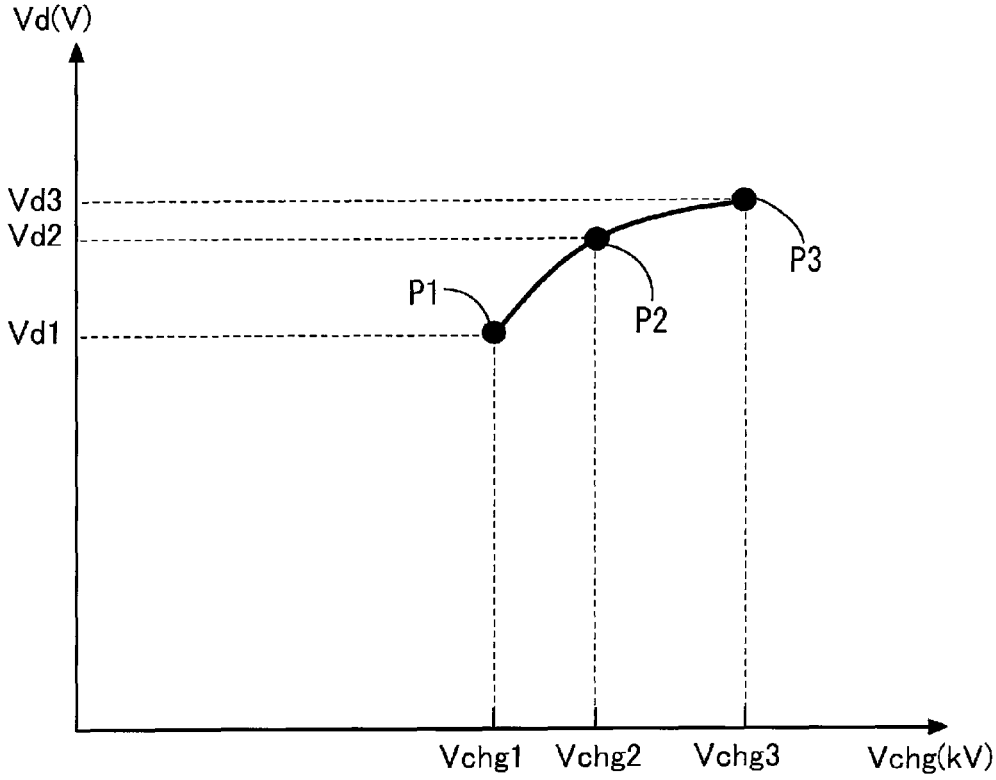
FIG. 7 is a graph illustrating the second approximate equation.

On the other hand, FIG. 6 is a flowchart illustrating a process of calculating a second approximate equation by calculating a plurality of the charge voltages Vchg and obtaining a data of a plurality of the auxiliary winding voltages Vd. In this case, the duty ratio of the PWM signal S1 is changed. FIG. 7 is a graph illustrating a curve representing the approximate equation. Note that most of the processes of the flowcharts illustrated in FIGS. 4 and 6 are executed by the CPU 61 in accordance with the processing programs, which are contained in the memory 100, when the printer 1 is in the testing mode.

3-1. Calculation of First Approximate Equation

In the high-voltage inspection during manufacture of the printer 1, as illustrated in FIG. 2, first, the testing resistor 50 is connected to a charge terminal CHG and a grid terminal GRID of the process cartridge 17 (step S110 in FIG. 4). In detail, one end of the testing resistor 50 is connected to the charge terminal CHG and the other end of the testing resistor 50 is connected to the grid terminal GRID. The testing resistor 50 is a high-voltage testing tool. Note here that the charge terminal CHG and the grid terminal GRID are terminals connected to the charging wire 29*a* and the grid 29*b*, respectively. That is, the discharge path between the charging wire 29*a* and the grid 29*b* is replaced with the testing resistor 50.

Next, the operator operates a selection switch etc. of the printer 1 to select an instruction to execute the testing mode to calculate the first approximate equation. At input of the designation to the printer 1, a predetermined target value Vo1 of the grid-FB voltage Vgf1, i.e. a target value of the grid current Igr is set (step S115).

At the setting of the target value Vo1 of the GRID-FB voltage Vgf1, the CPU 61, first, generates the PWM signal S1 having a duty ratio corresponding to the target value Vo1 of the GRID-FB voltage Vgf1. The CPU 61 supplies the generated PWM signal S1 to the high-voltage applying circuit 60, thereby outputting the charge voltage (testing charge voltage) Vchg1 to the testing resistor 50 (step S120). Then, the CPU 61 waits for a predetermined time until the charge voltage Vchg1 stabilizes (step S125).

Next, in step S130, the CPU 61 reads the GRID-FB voltage Vgf1 from the detection signal S3 and determines whether the read GRID-FB voltage Vgf1 is within a predetermined range (step S135). If the GRID-FB voltage Vgf1 is not within the predetermined range (step S135: "No"), the CPU 61 determines that an error has occurred and stops the voltage generating operation of the high-voltage applying circuit 60 (step S137).

On the other hand, if the GRID-FB voltage Vgf1 is within the predetermined range (step S135: "Yes"), the process goes to step S140 so that the CPU 61 reads the auxiliary winding voltage Vd1 from the detection signal S2. Then, in step S145, the CPU 61 reads the GRID-FB voltage Vgf1 from the detection signal S3 and determines whether the read auxiliary winding voltage Vd1 is within a predetermined range (step S145). If the auxiliary winding voltage Vd1 is not within the predetermined range (step S145: "No"), the CPU 61, similar to the above, determines that an error has occurred and stops the voltage generating operation of the high-voltage applying circuit 60 (step S147).

On the other hand, if the auxiliary winding voltage Vd1 is within the predetermined range (step S145: "Yes"), the process goes to step S150 so that the CPU 61 calculates the charge voltage Vchg1 using the GRID-FB voltage Vgf1 and the above-described Equation 1. Then, in step S155, the CPU 61 calculates, for example, the linear approximate equation illustrated in FIG. 5 using the read auxiliary winding voltage Vd1 and the calculated charge voltage Vchg1. That is, in the step S155, the first approximate equation, which is the linear approximate equation, is calculated from the coordinates of the origin (0, 0) and the coordinates of point P1 (the charge voltage Vchg1, the auxiliary winding voltage Vd1).

Next, in step S160, the CPU 61 stores the calculated first approximate equation in the memory 100 such as an NV (nonvolatile) RAM. Then, in the image forming mode, the CPU 61 detects the charge voltage Vchg from the auxiliary winding voltage Vd and using the stored first approximate equation.

In this case, only by obtaining at least the single set of data of the calculated charge voltage Vchg and the feedback voltage Vd, the first approximate equation can be calculated by a line passing the origin. This makes it possible to easily calculate the first approximate equation and, at the same time, to save the memory capacity.

3-2. Calculation of Second Approximate Equation

Next, the process of calculating the second approximate equation will be described with reference to FIGS. 6 and 7. In the process of calculating the second approximate equation, as described above, the duty ratio of the PWM signal S1 is changed, the plurality of charge voltages Vchg are calculated, and the data of the plurality of auxiliary winding voltages Vd is obtained. For this purpose, a plurality of target values Vo of the GRID-FB voltage Vgh (the grid current Igr) are set, and, as illustrated in FIG. 7, coordinates of a plurality of points (three points P1 to P3 are illustrated in this illustrative aspect) are calculated to calculate the approximate equation. Specifically, in this illustrative aspect, the setting of the target value Vo is changed so that the plurality of the charge voltages Vchg calculated from the GRID-FB voltage Vgf and the Equation 1 vary in the vicinity of an abnormal discharge voltage value. Note that the number of the plurality of points is arbitrary; it may be determined as required. Furthermore, the plurality of points do not have to be in the vicinity of the abnormal discharge voltage value.

Note that the process similar to the process in FIG. 4 are designated with identical step numbers, while the description are omitted. Furthermore, similar to the calculation of the first approximate equation, most of the process of calculating the second approximate equation is executed by the CPU 61 in accordance with the processing program contained in the memory 100. Furthermore, in the high-voltage inspection (in the testing mode), the charger 29 is replaced with the testing resistor 50 (the testing tool) and is connected to the discharge path between the charging wire 29*a* and the grid 29*b* (step S110). Then, the operator operates the selection switch of the printer 1, thereby selecting the instruction to execute the testing mode to calculate the second approximate equation. At input of the designation to the printer 1, the process of S115 and thereafter in the flowchart illustrated in FIG. 6 is executed.

In step S210 of the flowchart illustrated in FIG. 6, the CPU 61 temporarily saves the GRID-FB voltage Vgf1 and the auxiliary winding voltage Vd1 detected in the process of the steps from S110 to S145 in the memory 100.

Similar to this, in step S270, the CPU 61 temporality saves a GRID-FB voltage Vgf2 and the auxiliary winding voltage Vd2 detected in the process of the steps from S215 to S240 in the memory 100.

Furthermore, similarly, in step S370, the CPU 61 saves a GRID-FB voltage Vgf3 and the auxiliary winding voltage Vd3 detected in the process of the steps from S315 to S340 in the memory 100.

Next, in step S380, the charge voltages (testing charge voltages: Vchg1, Vchg2, Vchg3) are calculated using the GRID-FB voltages (Vgf1, Vgf2, Vgf3) and the Equation 1. Then, the second approximate equation is calculated using the calculated charge voltages (Vchg1, Vchg2, Vchg3) and the detected auxiliary winding voltages (Vd1, Vd2, Vd3).

The second approximate equation is calculated as a curve (high-order) equation containing, for example, the three points (having the coordinates of point P1 (the charge voltage Vchg1, the auxiliary winding voltage Vd1), the coordinates of point P2 (the charge voltage Vchg2, the auxiliary winding voltage Vd2), and the coordinates of point P3 (the charge voltage Vchg3, the auxiliary winding voltage Vd3)) as illustrated in FIG. 7. Alternatively, the second approximate equation may be calculated as a linear equation as illustrated in FIG. 3.

Next, in step S390, the CPU 61 stores the calculated second approximate equation in the memory 100 such as the NV (nonvolatile) RAM. Then, in the image forming mode, the CPU 61 substitutes the detected auxiliary voltage Vd into the second approximate equation to calculate, and detect, the charge voltage Vchg. The second approximate equation is more accurate than the first approximate equation and therefore is suitable in the case where the accuracy in detecting the charge voltage Vchg is required as described above, e.g. when controlling the charge voltage Vchg in the vicinity of the abnormal discharge voltage value.

Specifically, if the detected charge voltage Vchg is a voltage that is smaller by a predetermined value than the abnormal discharge voltage value and is equal to or larger than an upper limit value of the charge voltage, the CPU 61 stops the operation of the voltage output circuit 72. This makes it possible to more reliably reduce generation of the abnormal discharge. Furthermore, the CPU 61 generates a notification signal S4 to notify cleaning of the charging wire 29*a*. Then, the CPU 61 outputs the notification signal S4 toward, for example, a display device 10 (see FIG. 1) disposed in the front face of the printer 1, causing the display device 10 to display the cleaning information. This makes it possible to more reliably urge the user to clean the charging wire 29*a* before the abnormal discharge is generated, so that generation of the abnormal discharge is reduced. Note that generation of the notification signal S4 and output of the notification signal S4 to the display device 10 are optional.

4. Effects of Illustrative Aspect

The charge voltage Vchg is detected by correlating the auxiliary winding voltage Vd detected by the auxiliary winding 75*c* etc. in the image formation with the charge voltage Vchg calculated in the testing mode. That is, in the testing mode, the first or second approximate equation that represents the relation between the auxiliary winding voltage Vd and the charge voltage Vchg is calculated and then is stored in the memory 100. Then, the charge voltage Vchg in the image formation is detected by substituting, in the image formation, the detected auxiliary winding voltage Vd into the first or second approximate equation.

Accordingly, because it is the detection of the charge voltage Vchg using the auxiliary winding 75*c*, power loss in the detection of the charge voltage Vchg is less than the case of resistor voltage dividing. Moreover, in comparison with the conventional case of using the turn ratio, the accuracy in detecting the charge voltage Vchg can be better. In addition to this, because the existing grid-current detecting circuit 84, which is used for the charge current control, can be used also for the detection of the charge voltage Vchg, this configuration reduces the cost.

<Other Aspects>

The present invention is not limited to the illustrative aspect described above with reference to the drawings. For example, the following illustrative aspects are also included within the scope of the present invention.

(1) In the above-described illustrative aspect, the first or second approximate equation that represents the relation between the charge voltage Vchg calculated by the CPU (the calculating device) 61 and the feedback voltage Vd is illustratively stored in the memory 100. The present invention is not limited to this. The relation between the charge voltage Vchg and the feedback voltage Vd in the testing mode may be stored simply as a table data in the memory 100. In this case, because it is unnecessary to calculate the charge voltage Vchg in the image forming mode, the detection can be quickly operated than in the case where the charge voltage Vchg in the image forming mode is detected from the approximate equation. The table data in that case may also be a data obtained from the above first or second approximate equation calculated in advance.

(2) In the above illustrative aspect, the "testing mode" is assumed to be a "testing mode" during the high-voltage inspection in manufacture of the printer 1. The present invention is not limited to this. For example, it may be the "testing mode" that is set when the user uses the printer 1.

What is claimed is:

1. An image forming apparatus comprising:

a charger including a charging wire and a grid;

a voltage output circuit including a transformer having an auxiliary winding, the voltage output circuit being configured to generate a charge voltage using the transformer and apply the charge voltage to the charger;

a grid-current detecting circuit configured to detect a grid current that flows between the charging wire and the grid in accordance with the applying of the charge voltage;

a charge-voltage detecting circuit configured to obtain the charge voltage from a feedback voltage that is generated by the auxiliary winding;

a calculating device configured to, in a testing mode to replace a discharge path between the charging wire and the grid with a testing resistor having a predetermined resistance, calculate the charge voltage using the resistance of the testing resistor and a detection value by the grid-current detecting circuit; and a controller configured to, in an image forming mode to form an image, detect the charge voltage from the feedback voltage using a relation between a value of the feedback voltage which is detected by the charge-voltage detecting circuit in the testing mode and the charge voltage calculated by the calculating device.

2. The image forming apparatus according to claim 1 further comprising a storage configured to store the feedback voltage which is obtained in the testing mode and the calculated charge corresponding to the feedback voltage as a table data.

3. The image forming apparatus according to claim 1, wherein:

the grid-current detecting circuit includes a voltage dividing resistor configured to divide a voltage of the grid, the voltage dividing resistor being for detecting the grid current; and the calculating device calculates the charge voltage using a value of the testing resistor, a value of the voltage dividing resistor, and a current value detected by the grid-current detecting circuit.

4. The image forming apparatus according to claim 3, wherein:

the calculating device calculates a first approximate equation from the charge voltage calculated by the calculating device and the feedback voltage which is obtained in the testing mode; and the controller detects the charge voltage in the image forming mode on a basis of the first approximate equation.

5. The image forming apparatus according to claim 3 further comprising:

a control-signal generating device configured to generate a control signal for controlling the charge voltage so that the grid current is at a target value; and a changing device configured to change the target value, wherein:

accompanying the changing of the target value, the calculating device calculates a second approximate equation from a plurality of the feedback voltages calculated by the calculating device and a plurality of the feedback voltages which is obtained in the testing mode; and the controller detects the charge voltage in the image forming mode on a basis of the second approximate equation.

6. The image forming apparatus according to claim 5, wherein:

When the calculating device calculates the second approximate equation, the changing device changes the target value so that the calculated plurality of the charge voltages vary in a vicinity of an abnormal discharge voltage value.

7. The image forming apparatus according to claim 6, wherein:

in a case where, in the image forming mode, the detected charge voltage is equal to or larger than an upper limit value of the charge voltage, the upper limit value being smaller by a predetermined value than the abnormal discharge voltage value, the controller stops operation of the voltage output circuit and/or generates a notification signal to notify cleaning of the charging wire.

8. A method of generating charge voltage when applying a charge voltage to a charger including a charging wire and a grid by a charge-voltage applying circuit including a transformer having an auxiliary winding configured to generate a feedback voltage in accordance with the charge voltage, the method comprising the steps of:

prior to generating the charge voltage, replacing a discharge path between the charging wire and the grid of the charger with a testing tool having a predetermined electrical parameter and applying a testing charge voltage to the charger;

detecting a grid current that flows between the charging wire and the grid in accordance with the applying of the testing charge voltage;

detecting the feedback voltage in accordance with the applying of the testing charge voltage;

calculating the testing charge voltage using the electrical parameter of the testing tool and the detected grid current;

calculating an approximate equation using the detected feedback voltage and the calculated testing charge voltage, the approximate equation representing a relation between the feedback voltage and the charge voltage;

detecting the charge voltage from the feedback voltage by using the approximate equation, when removing the testing tool and generating the charge voltage; and controlling the charge-voltage applying circuit so as to output the detected charge voltage.

9. The method according to claim 8, wherein:

the testing tool is a resistor; and the predetermined electrical parameter is a resistance value of the resistor.

* * * * *